US005500089A

United States Patent [19]

Huang et al.

[11] Patent Number: 5,500,089

[45] Date of Patent: Mar. 19, 1996

[54] METHOD FOR MAKING DISPOSABLE BOWLS AND TRAYS

[76] Inventors: Frank Huang, 5/F-4, No. 12, Lane 147, Sec 2, Chung-Yi Load, Tainen City; Chyi-Ying Wu, No. 71, Piao-Fu Load, Mai-Feng Tsun, Mai-Liao Hsiang, Yunlin County, both of Taiwan

[21] Appl. No.: 267,533

[22] Filed: Jun. 29, 1994

Related U.S. Application Data

[63] Continuation-in-part of Ser. No. 80,779, Jun. 24, 1993, abandoned.

[51] Int. Cl.[6] ..... D21J 1/04; D21J 3/10

[52] U.S. Cl. ..... 162/226; 162/227; 162/223; 162/231

[58] Field of Search ..... 162/177, 226, 162/227, 224, 410, 175, 231, 223; 106/214, 163.1; 426/138; 428/35.6; 264/86, 87

[56] References Cited

U.S. PATENT DOCUMENTS

| | | | |
|---|---|---|---|
| 528,612 | 11/1894 | Shaw | 162/226 |
| 1,963,134 | 6/1934 | Keiding | 182/222 |
| 1,995,586 | 3/1935 | Schopper et al. | 162/226 |
| 3,306,813 | 2/1967 | Reifers | 162/410 |
| 4,014,737 | 3/1977 | Brennan | 162/226 |
| 4,377,440 | 3/1983 | Gasland | 162/177 |
| 4,982,872 | 1/1991 | Avery | 220/461 |
| 5,039,465 | 8/1991 | Freeman et al. | 162/224 |
| 5,252,129 | 10/1993 | Cheng | 162/231 |

OTHER PUBLICATIONS

Rydholm, Sven A., Pulping Process, Interscience Publishers, New York, N.Y., 1967, pp. 677–692.

*Primary Examiner*—Brenda A. Lamb
*Attorney, Agent, or Firm*—Bacon & Thomas

[57] ABSTRACT

A method is used for making disposable trays and bowls with organic materials or herbaceous plants that can be easily disintegrated and that has low economical value. The organic materials include straws, bagasses or forage grasses etc., which are cheap and can be easily obtained. The manufacturing costs of the trays and bowls are thus competitive in price and suitable for producing disposable trays and bowls for containing food. No waste water and gas will be produced such that the method meets the requirement of environmental protection.

6 Claims, 4 Drawing Sheets

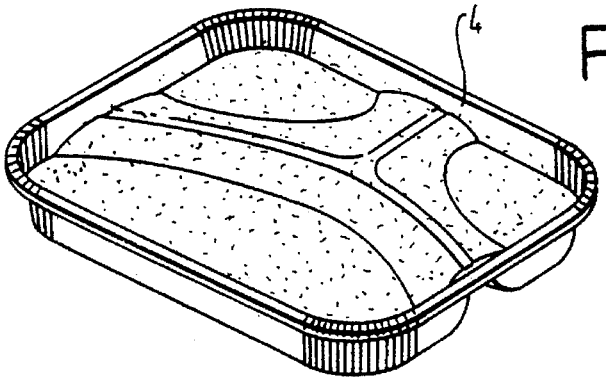
FIG. 2
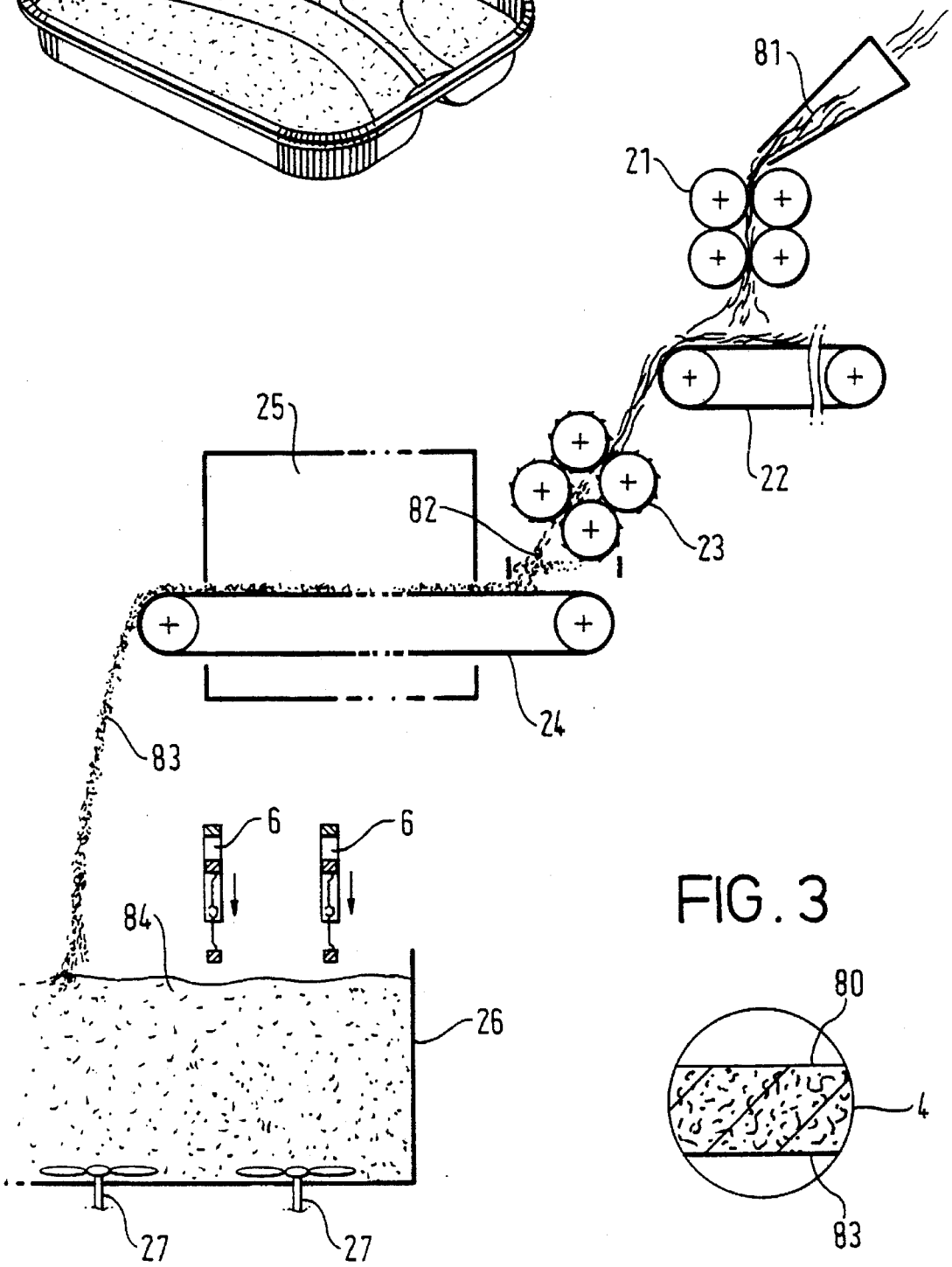
FIG. 4
FIG. 3

METHOD FOR MAKING DISPOSABLE BOWLS AND TRAYS

CROSS REFERENCE TO RELATED APPLICATION

This is a continuation-in-part of application Ser. No. 08/080,779, filed Jun. 24, 1993, abandoned.

BACKGROUND OF THE INVENTION

1. Field of the Invention

The present invention relates to a method, and more particularly to a method for making disposable bowls and trays.

2. Description of the Prior Art

Styrofoam materials have been widely used for making containers in different forms, such as trays and bowls, etc., for containing food, and such as plates and blocks for other applications. The styrofoam material is cheap such that it is widely used to make disposable tableware or foodstuff packings for sanitary purposes. However, the difficulty to disintegrate styrofoam makes it detrimental to the environment. Therefore, under the situation of ever increasing awareness of environmental protection around the world, styrofoam products are gradually replaced by those disintegrable paper ones.

Though paper products have the advantage of being disintegrable after throwing away, they reveal some facts which will seriously affect the environment in the long run. For example, the raw material of paper products is coming from trees. Excessive felling of trees has made forests less and less in the earth, which results in an ecological imbalance. In addition, the manufacturing process of paper products is complicated, including such steps as bleaching, scouring and dyeing, etc., from which it is quite possible that the waste water thus formed is likely to bring about secondary pollutions to the surroundings. Furthermore, according to the statistics, replanting trees fail to complement the felled ones. Consequently, in addition to the ecological imbalance as mentioned above, the cost to acquire trees as raw materials will certainly soar year by year, thereby increasing the production cost of paper products.

The present invention has arisen to mitigate and/or obviate the afore-described disadvantages of the conventional methods for making bowls and trays.

SUMMARY OF THE INVENTION

The primary objective of the present invention is to provide a method for making disposable trays and bowls, in which disintegrable organic materials are used for producing disposable trays or bowls for containing food, or for producing plates and blocks for other applications.

The other objective of the present invention is to provide a method for making disposable trays and bowls, in which no waste water and gas will be produced such that the method meets the requirement of environmental protection.

In accordance with one aspect of the invention, there is provided a method for making tray means comprising selecting natural plants rich in fibers; preparing starch material; cutting and separating the natural plants into fiber sections; mixing the fiber sections with the starch material; adding water to the mixed fiber sections and the starch material so as to form starch paste material; agitating the mixed fiber sections and the starch paste material so as to form a dense mixing mass; scooping the dense mixing mass with a screen material; and hot-pressing the dense mixing mass and the screen material so as to form the tray means. Alternatively, before the fibers are added into the starch, water is added into the starch in order to form the starch paste. The fibers are then added into the starch paste for mixing with the starch paste.

The hot-pressing process includes an upper mold and a lower mold each including a plurality of apertures formed therein, the apertures of the upper mold are vacuumed so as to move the tray means with the upper mold and so as to disengage the tray means from the upper mold, and air is supplied into the apertures of the upper mold so as to disengage the tray means from the upper mold.

Further objectives and advantages of the present invention will become apparent from a careful reading of a detailed description provided hereinbelow, with appropriate reference to accompanying drawings.

BRIEF DESCRIPTION OF THE DRAWINGS

FIG. 2 is a perspective view illustrating a tray made by the method in accordance with the present invention;

FIG. 3 is a partial cross sectional view illustrating the cross section of the tray;

FIG. 4 is a schematic view illustrating the processes for making the starch material;

DETAILED DESCRIPTION OF THE PREFERRED EMBODIMENT

Figure 1:
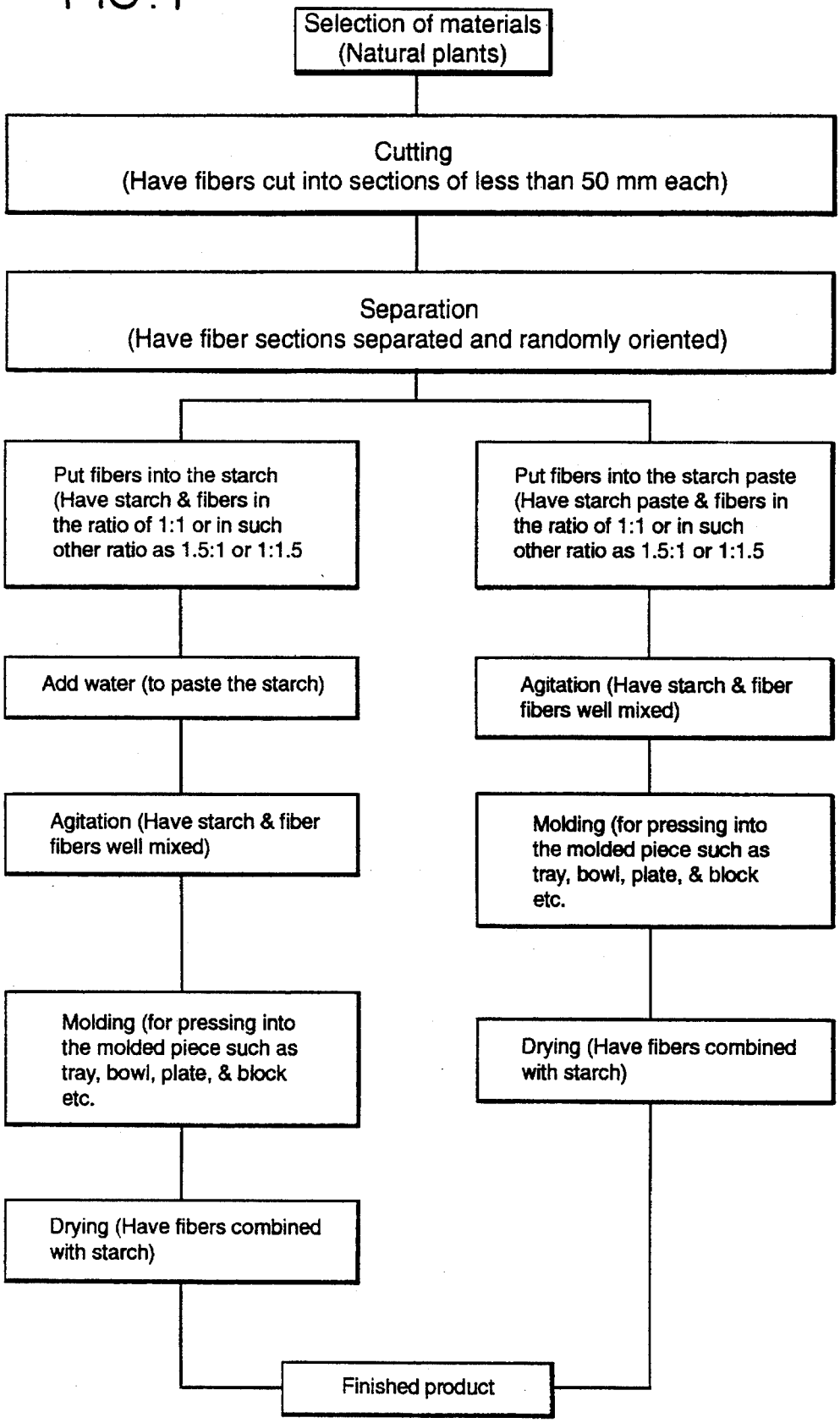
FIG. 1 is a block diagram illustrating the method in accordance with the present invention.

Referring to the drawings, and initially to FIGS. 1 and 2, a method in accordance with the present invention is provided for making trays and bowls 4 with waste fiber materials or herbaceous plants with low economical value, such as straws, bagasses and forage grasses etc. The waste fiber materials are cheap and can be easily obtained, thereby making the manufacturing costs of the tray and bowl products competitive in price and absolutely suitable for producing disposable trays and bowls etc., for containing food.

The method comprises the following processes and employs two kinds of raw materials for making the trays and bowls, one is the natural plants which are rich in fibers, another one is starch. The natural plants including the stems and leaves thereof are cut into fiber sections of less than 50 mm each. Beat the stem and leaf sections so as to separate their fibers which are thus randomly oriented and irregularly distributed.

The fibers are then put into the starch for mixing with the starch. Water is then added to paste the starch. The fibers and starch paste are then well agitated to become a dense mixing mass. Alternatively, as shown in FIG. 1, before the fibers are added into the starch, water is first added into the starch in order to form the starch paste, such that the fibers may be added into the starch paste for mixing purposes. The reason why the starch is selected for mixing with natural fibers is because the starch usually contains about 20% amylose which may easily combine the natural fibers to help reinforce the combination strength of starch and natural fibers.

The mixing ratio of fibers to starch can be varied with the different requirements of the products to be made, such as the thickness, area and strength of the products.

For example, when the products for containing food are 1–2 mm in thickness, the mixing ratio of fibers to starch is about 1:1. In case the products are more than 1–2 mm thick, the dependence of starch of the fibers to enhance the strength is decreased due to increase of thickness, the mixing ratio can thus be about 1 (fibers) to 1.5 (starch). However, when the products are less than 1–2 mm thick, the dependence of starch on the fibers to enhance the strength is increased due to decrease of thickness, the mixing ratio can thus be about 1.5 (fibers) to 1 (starch).

Referring next to FIG. 4, illustrated is a process for making the mixed fibers and starch paste. The raw materials 81 rich in fibers are compressed by rollers 21 and are conveyed to cutters 23 by a conveyer 22 so as to be cut into fiber sections 82. The fiber sections 82 are then moved through a dry oven 25 by another conveyer 24 so as to be dried, the dried fibers 83 are then dropped into a container 26 which accommodates starch paste 84. Starch and water are disposed in the container 26 with suitable ratio and are stirred into starch paste 84 by agitators 27 which also mix the dried fibers 83 and the starch 84 together.

Figure 5:
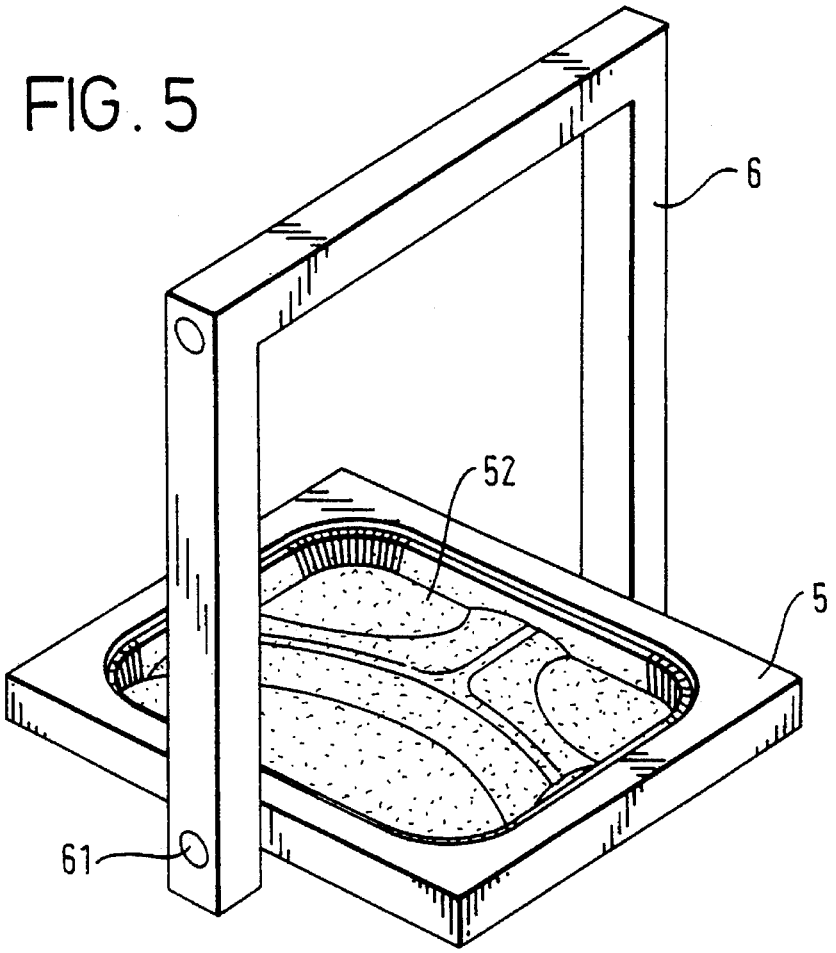
FIG. 5 is a perspective view illustrating the mold for scooping fiber materials.
Figure 6:
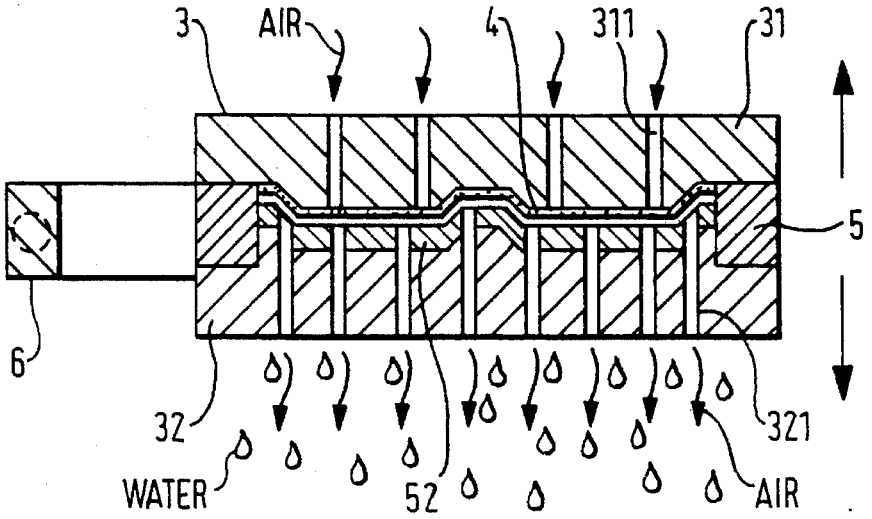
FIG. 6 is a cross sectional view illustrating the molding process of the method.

Referring next to FIG. 5, a board 5 includes a screen 52 disposed therein for scooping the mixed fiber and starch contained in the container 26. The screen 52 includes fine apertures formed therein for draining water contained in the mixed fiber and starch. The board 5 is pivotally coupled to a frame 6 at a pivot axle 61. An actuator (not shown) is coupled to the frame 6 for moving the board 5 downward into the starch paste 84 for scooping the mixed fiber and starch. The frame 6 is then rotated to a horizontal position, best shown in FIG. 6. The mixed fiber and starch supported on the screen 52 are then compressed by a mold device 3 including an upper mold 31 and a lower mold 32, so as to form the shape of the product to be made. The upper mold 31 and the lower mold 32 each includes a number of apertures 311, 321 formed therein for draining water and for air circulation purposes. It is preferable that the mold device 3 includes heating device therein for heating the mixed fiber and starch so as to dry and to harden the product. After drying process, as best shown in FIG. 3, the fibers 83 are randomly oriented and irregularly distributed within the starch 80.

Figures 7A, 7B, 7C, 7D, 7E, 7F, 7G, 7H:
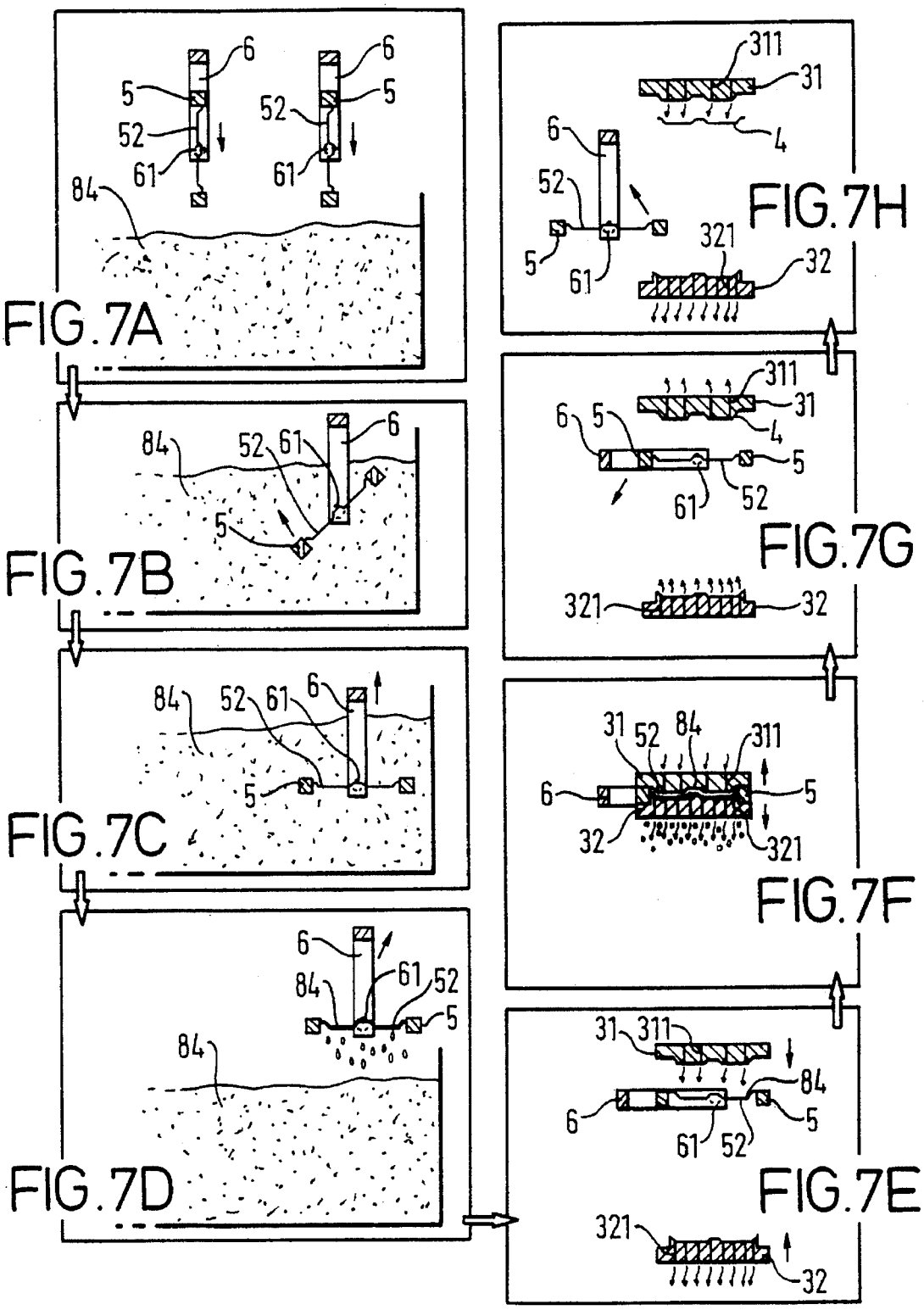
FIGS. 7A to 7H are schematic views illustrating the processes of the method.

Referring next to FIGS. 7A to 7H, two or more boards 5 are moved downward into the starch paste 84 by the frames 6 (FIG. 7A). The board 5 is then rotated to a horizontal position so as to scoop the mixed fibers and starch (FIGS. 7B, 7C and 7D). The frame 6 is then rotated to a horizontal position (FIG. 7E), and the mixed fiber and starch and the screen 52 are then compressed and heated by the molds 31, 32 of the mold device 3 so as to be dried and hardened. After compressing and heating processes, the mold pieces 31, 32 are separated, at this moment, the apertures 311 are preferably vacuumed so as to move the product 4 with the upper mold 31. The product 4 is then separated from the upper mold 31 when air is pumped through the apertures 311.

Accordingly, the method in accordance with the present invention employs disintegrable organic materials only, the disintegrable organic materials including fibers and starch can be easily disintegrated. The manufacturing processes thereof will not produce waste water and gas such that no second pollution will occur. The method meets the requirements of environmental protection and is suitable for producing disposable containers for containing food. In addition, the materials can be easily obtained with lowest price, thereby making the production cost of the finished products competitive in price.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A method of making a container for food which comprises:

selecting natural herbaceous plants rich in fibers;

compressing the natural herbaceous plants;

cutting the compressed plants into fiber sections;

drying the fiber sections;

adding the dried fiber sections to a container of starch paste containing water;

mixing the dried fiber sections and starch paste to form mixed fiber and starch;

passing a shaping means comprised of a screen containing fine apertures through the container of the mixed fiber and starch to scoop the mixed fiber and starch onto the screen;

draining the water from the mixed fiber and starch through the fine apertures;

placing the shaping means with the mixed fiber and starch in a mold device comprising an upper mold member and a lower mold member;

compressing the mixed fiber and starch between the upper and lower mold members to form the food container;

separating the upper and lower mold members; and retrieving the food container from the mold device.

2. A method as claimed in claim 1 wherein the mold device further comprises a heating element and wherein the mixed fiber and starch are heat-pressed between the upper and lower mold members.

3. A method according to claim 1 wherein the-upper and lower mold members contain apertures.

4. A method according to claim 3 wherein a vacuum is applied through the apertures in the upper mold member during separation of the upper and lower mold members such that the food container moves with the upper mold member.

5. A method according to claim 4 wherein the food container is separated from the upper mold member by pumping air through the apertures in the upper mold member.

6. A method according to claim 1 wherein the natural herbaceous plants are forage grasses.

* * * * *